United States Patent [19]

Kubo

[11] 4,265,433

[45] May 5, 1981

[54] APPARATUS FOR REPAIRING THE TAP HOLE OF A CONVERTER

[75] Inventor: Sueki Kubo, Kitakyushu, Japan

[73] Assignee: Kurosaki Refractories Co., Ltd., Fukuoka, Japan

[21] Appl. No.: 22,254

[22] Filed: Mar. 20, 1979

[30] Foreign Application Priority Data

Feb. 3, 1979 [JP] Japan ..... 54/11700

[51] Int. Cl.[3] ..... C21B 7/12

[52] U.S. Cl. ..... 266/273; 266/45; 264/30; 222/146 C

[58] Field of Search ..... 266/271, 272, 273, 45; 264/30; 222/146 C, 330, 386

[56] References Cited

FOREIGN PATENT DOCUMENTS 42-232267 2/1967 Japan ..... 266/273

*Primary Examiner*—M. J. Andrews

*Attorney, Agent, or Firm*—Jordan and Hamburg

[57] ABSTRACT

This invention discloses a method and an apparatus which can efficiently repair the tap hole of a converter even under high temperature. The method and apparatus employ an injection pipe of a unique construction for applying refractory material onto the inner surface of the tap hole. Such injection pipe is of a circular cylindrical construction and is provided with a pipe cooling means and, preferably, with a perforated mold sleeve which encases the injection pipe. Due to such construction, the refractory material charged into the injection pipe can be smoothly and uniformly injected through an injection opening formed at the front portion of the injection pipe and apertures of the perforated mold sleeve onto the inner surface of the tap hole, whereby thus applied refractory material can show the improved adhesion rate and properties while defining a predetermined optimal diameter to the tap hole after the repairing operation.

24 Claims, 18 Drawing Figures

APPARATUS FOR REPAIRING THE TAP HOLE OF A CONVERTER

BACKGROUND OF THE INVENTION

This invention relates to a method and an apparatus for efficiently and uniformly applying refractory material onto eroded portions of the inner surface of a tap hole of a converter.

Conventionally, in tapping molten steel from a converter, the inner surface of the tap hole of the converter gradually erodes due to the molten steel and widens the bore or the inner diameter thereof. Such widening of the bore eventually shortens the time necessary for tapping and causes the splash of molten steel as well as the inclusion of slag into the tapped molten steel, whereby the thus produced steel cannot have uniform quality.

Accordingly, for assuring that the tapping time is kept within an allowable range, in one method, a refractory material carried on an elongated spoon-shaped trowel is manually applied onto the interior of the tap hole after each taping operation for narrowing the bore of the eroded tap hole.

In the second method, tapping operations are consecutively repeated until the tapping time reaches the allowable limit. Subsequently, the eroded tap hole is smoothed by removing the eroded portion of the refractory material and the slag adhered thereto. A sleeve-shaped tap hole brick is inserted into the smoothed eroded tap hole, and finally refractory material is sprayed or cast into the annular space formed by the sleeve-shaped tap hole brick and the interior of the smoothed eroded tap hole.

In the above two methods, however, the repairing operation must be conducted in a critical condition at a location adjacent to the converter under high temperature. Accordingly, the improvement of such operations has been greatly demanded.

Besides the above-mentioned repairing methods, a method in which the refractory material is sprayed onto the interior of the tap hole has been partially conducted. In this method, however, when the refractory material layer applied onto the interior of the tap hole becomes slightly thicker than the optimal value, such layer tends to peel off and furthermore cannot provide a uniform diameter throughout the tap hole from the tap opening to the innermost end of the tap hole. Accordingly, in the tapping operation, molten steel does not flow out smoothly and a portion of the molten steel splashes, whereby the thus tapped steel deteriorates in quality thereof. Furthermore, the refractory material applied onto the tap hole by spraying shows high porosity and low strength so that it is extremely difficult to prevent the rapid widening of the tap hole as well as the rapid peeling-off of the sprayed refractory material. Accordingly, a spraying operation must be conducted after every one or two tapping operations. Still furthermore, since the spray nozzle is subjected to the high temperature within the tap hole, the refractory material within the spray nozzle tends to harden so that the spray outlet is clogged and further spraying may become impossible.

Still another repairing method is disclosed in Japanese laid-open patent application No. SHO52-17703.

In this method, a reciprocable rod extendably passes through an injection pipe and a plurality of umbrella-shaped members attached to the front extremity of the reciprocable rod opens like an umbrella to seal the innermost end of the tap hole and subsequently a refractory material charged into the injection pipe from the tapping outlet of the tap hole is applied onto the interior of the tap hole through a plurality of apertures formed on the entire surface of the injection pipe.

In this method, however, the injection pipe must be always filled with refractory material to uniformly inject the refractory material from all the apertures formed on the injection pipe. Otherwise, namely, when the injection pipe accommodates as insufficient amount of the refractory material, the above-mentioned uniform injection covering the entire length of the injection pipe becomes impossible, thereby the thus repaired interior of the tap hole shows unfavorable properties. Furthermore, the above method generally retains some amount of refractory material within the injection pipe after the tapping operation is over. Refractory material must be removed from the injection pipe and the removal of such material is, in general, troublesome. On the other hand, if the refractory material is left within the injection pipe, the material within the injection pipe and the supply hose tends to harden.

Furthermore, this method mainly uses the slurry-like refractory material which has a high fluidity because when the refractory material is of high viscosity and low fluidity, the supply of refractory material under pressure through a long hose becomes extremely difficult. Accordingly, in the operation, the injection pipe must be withdrawn from the sealed tap outlet of the tap hole after the refractory material becomes completely hardened. However, when the injection pipe is withdrawn well before the predetermined time, the refractory material applied onto the interior of the tap hole cannot maintain the applied shape thereof and flows out. When the applied refractory material is in a semi-solid state, such material may peel off. Even if such peeling-off does not take place, since the semi-solid material still has a relatively high fluidity, the water or the binder which attributes the fluidity to the refractory material is vaporized so that the refractory material applied on the interior of the tap hole shows the coarse internal structure and thereby has low strength and a short lifetime.

Furthermore, such semi-solid material cannot provide a uniform inner diameter and smooth surface through the entire length of the tap hole.

Furthermore, in the above repairing method, the injection pipe is withdrawn after the applied refractory material is sufficiently hardened. However, since the applied refractory material adjacent to the discharge apertures of the injection pipe is simultaneously hardened along with the refractory material located within and close to the discharge apertures, the withdrawal of the injection pipe causes a shearing force to the internal surface of the tap hole, whereby the inner surface of the applied refractory material may peel off. Furthermore, since the refractory material within the injection pipe is also hardened, the disposal of the refractory material is extremely difficult.

It is an object of the present invention to provide a method and apparatus for repairing the tap hole of a converter furnace which can resolve the afore-mentioned defects of the conventional methods, and thereby can prolong the life-span of the tap hole of the converter.

This invention substantially provides a method for repairing the tap hole of a converter under high temperatures which is substantially conducted as follows.

(i) An injection pipe for applying refractory material onto the inner surface of the tap hole has its entire length enclosed by a porous cylindrical mold.

(ii) The injection pipe is inserted into the tap hole while being cooled by a coolant such as water.

(iii) The refractory material within the injection pipe is discharged from an opening formed at the front portion of the injection pipe through apertures of the perforated mold sleeve onto the inner surface of the tap hole.

Due to the above method, the thus applied refractory material can show the improved adhesion rate and properties.

This invention also provides an apparatus for efficiently conducting the above repairing methods.

DETAILED DESCRIPTION OF THE DISCLOSURE

The above repairing method and apparatus are described in detail hereinafter in conjuction with the following embodiments.

FIRST EMBODIMENT

The apparatus employed for this embodiment is shown in FIG. 1 to FIG. 12.

Figure 1:
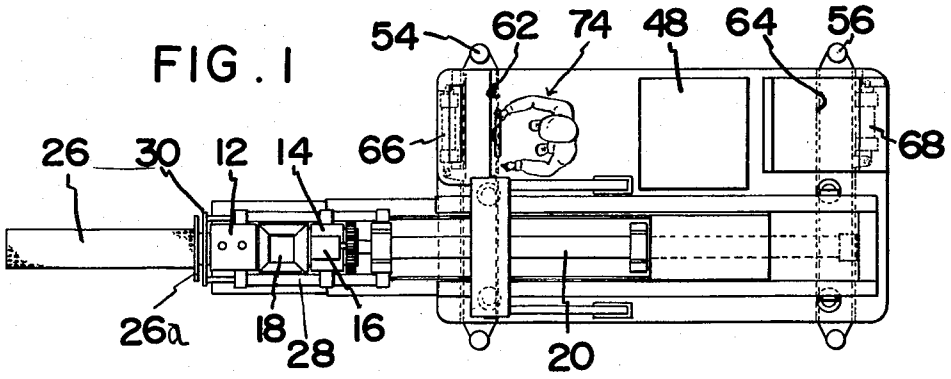
FIG. 1 is a plan view of the apparatus of the first embodiment of the present invention.
Figure 2:
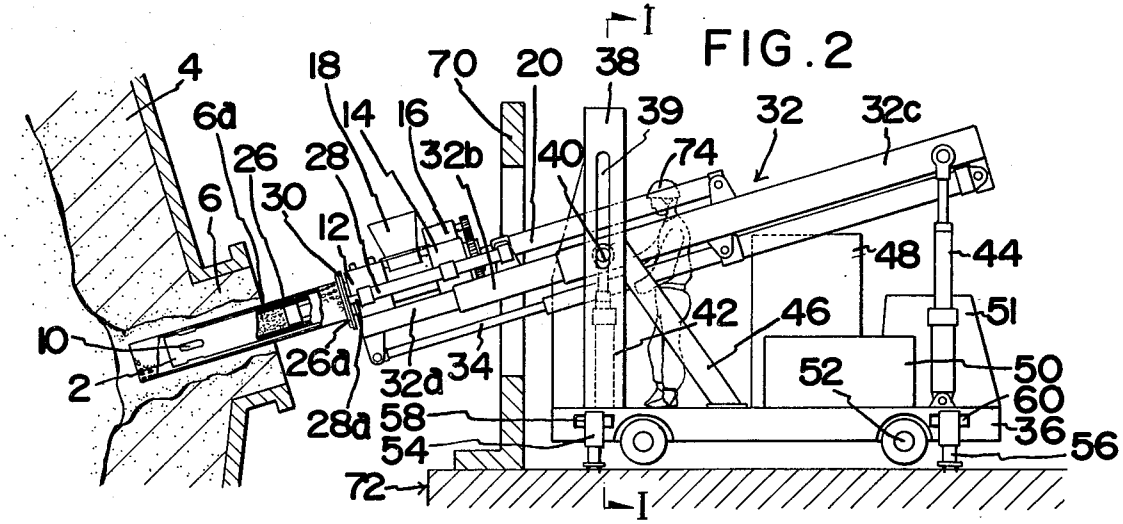
FIG. 2 is a side view of the above apparatus.
Figure 3:
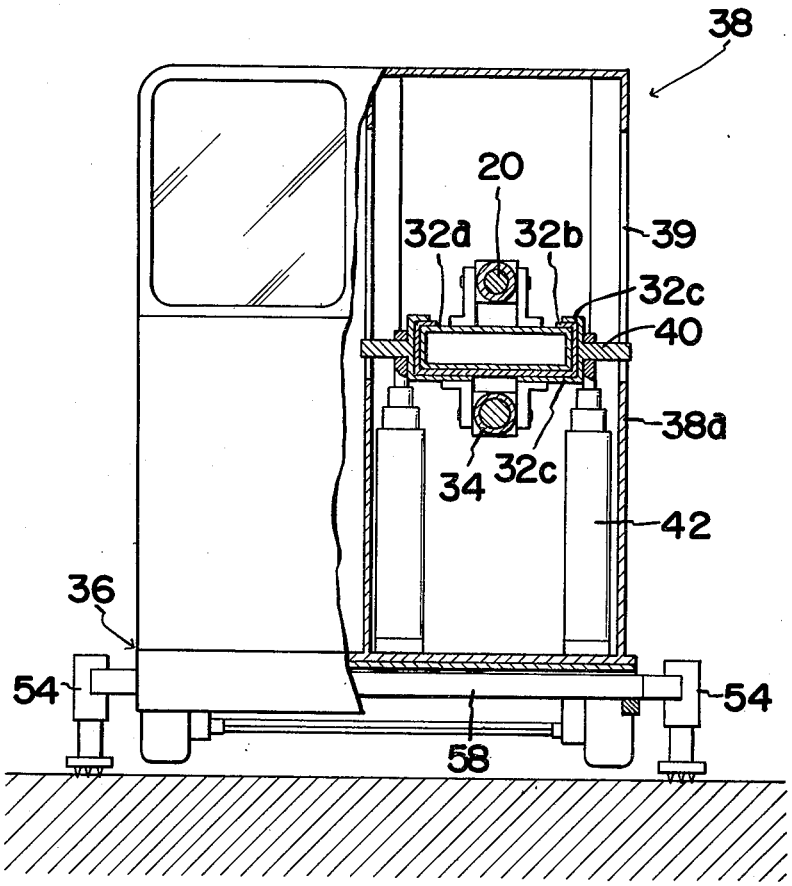
FIG. 3 is a cross-sectional view of the above apparatus taken along line I—I of FIG. 2.

In FIG. 1 and FIG. 2, a refractory material injection pipe 2 (the construction thereof is described later in great detail) is concentrically disposed within a tap hole 6 of a converter 4. The injection pipe 2 is movable toward or away from the tap hole 6. The injection pipe 2 is provided with an injection opening 10 at the front extremity thereof such that the refractory material charged into the injection pipe 2 is extruded through the injection opening 10 into the tap hole 6 and adheres to the inner surface of the tap hole 6. The injection pipe 2 has its proximal end rotatably supported by a first bearing 12 and a second bearing 14 and the rotation of the injection pipe 2 is effected by a power-operated motor 16 mounted on the second bearing 14. A refractory charging device 18 is disposed between the first and second bearings 12 and 14 and the charging device has the lower opening thereof intermittently communicated with the injection pipe 2 so as to charge the desired amount of refractory material into the injection pipe 2. It must be noted, however, that the charging device 18 is disposed as a separate and independent unit from the injection pipe 2 such that the rotation of the injection pipe 2 is not transferred to the charging device 18. Furthermore, adjacent to the rear end of the injection pipe 2, a refractory material extruding cylinder 20 is coaxially disposed. The extruding cylinder 20 is provided with a piston rod 22 and a piston head 24, both of which can slidably move within and along the injection pipe 2. Due to the slide movement of the piston head 24, the refractory material charged into the injection pipe 2 is injected from the opening 10 and adheres to the inner surface of the tap hole 6. The injection pipe 2 is also provided with a perforated mold sleeve 26 which substantially loosely encases the injection pipe 2 throughout the entire length thereof. The multiplicity of apertures are formed on the entire or partial portion of the perforated mold sleeve 26. The inner diameter of the perforated mold sleeve 26 is defined such that the diameter is substantially equal to a predetermined optimal diameter of the tap hole 6 prior to the tapping operation. The perforated mold sleeve 26 has a flange portion **26*a* at the proximal end thereof and such flange portion 26*a* abuts to an outer end opening 6*a* of the tap hole 6 to restrict the insertion of the perforated mold sleeve 26 into the tap hole 6**.

Two mold-sleeve contacting cylinders 28 are parallely located adjacent to the proximal end of the refractory material injection pipe 2 such that they sandwich the injection pipe 2. An annular compacting pad 30 which has an outer shape corresponding to the shape of the flange portion **26*a* is slidably disposed on the proximal portion of the injection pipe 2**.

Actuating rods **28*a* of the mold-sleeve contacting cylinders 28 have their distal ends connected with the annular compacting pad 30 such that the actuation of cylinders 28 imparts the slide movement of the annular compacting pad 30 along the injection pad 2. As the compacting pad 30 slides, the pad 30 comes into contact with the flange portion 26*a* of the mold sleeve 26 and thereafter urges the flange portion 26*a* to the outer end opening 6*a* of the tap hole 6**.

Numeral 32 indicates an extendable carrier frame which integrally carries the above-mentioned injection pipe 2, the perforated mold sleeve 26, the first bearing 12, the second bearing 14, the extruding cylinder 20 and the mold-sleeve contacting cylinder 28. The carrier frame 32 consists of a first carrier portion **32*a*, a second carrier portion 32*b* which slidably carries the first carrier portion 32*a* and a main carrier portion 32*c* which slidably carries the second carrier portion 32*b***.

The first bearing 12, the second bearing 14, the mold-sleeve contacting cylinders 28 and the extruding cylinders 20 are mounted on the first carrier portion **32*a***.

A carrier extending cylinder 34 is disposed below and parallel to the bottom of the carrier frame 32. Such cylinder 34, when actuated, can telescopically extend or retract the carrier frame 32. Simultaneously, devices such as the injection pipe 2 and the perforated mold sleeve 26 mounted on the carrier frame 32 are extended to or retracted from the tap hole 6.

The carrier frame 32 of the above construction is tiltably supported by a tilting mechanism on a transport car 36. Referring to the construction of the tilting mechanism, an over-head reaction support 38 is disposed at the front of the transport car 36. This support 38 substantially bridges the extending carrier frame 32. Guide pins 40 are secured to the side walls of the main carrier portion 32*c* and these pins 40 are vertically slidable within elongated vertical grooves 39 formed on side upright plates of the overhanging reaction support 38. Such provision of guide pins 40 enables the reaction support 38 to receive the reaction exerted by the actuation of the refractory material extruding cylinder 20 and/or the carrier extending cylinder 34. The main carrier portion 32*c* is supported by two spaced-apart upright cylinders 42, 44 which are disposed at the front and rear portion of the transport car 36 respectively. To be more specific, the front upright cylinders 42 have their actuating rods pivotally connected with the guide pins 40 while the rear upright cylinders 44 have their actuating rods pivotally connected with the rear end of the main carrier portion 32*c*. Numeral 46 indicates a bracket for reinforcing the reaction support 38.

Due to the above construction, along with the actuation of the front and rear upright cylinders 42, 44, the injection pipe 2 can readily take a desired injection angle which corresponds to the tilting angle of the tap hole 6. A hydraulic unit 48, a control panel 50 or an internal combustion engine 51 can be mounted on the transport car 36, if desired, as shown in the drawings. Although the transport car 36 is movable on the operation site with four drive wheels 52, the transport car 36 is firmly secured to a floor 72 during the repairing operation due to the front and rear elevatable riggers 54, 56 which are provided with spikes. The front and rear elevatable riggers 54, 56 have their upper ends respectively secured to front and rear transverse support members 58, 60 and these transverse support members 58 and 60 loosely pass through the front and rear transverse grooves 62, 64 formed on the front and rear ends of the transport car 36. Parallel to transverse support members 58 and 60, carrier-frame shifting cylinders 66, 68 are mounted on the front and rear ends of the transport car 36. Each shifting cylinder 66 and 68 has one end thereof secured to the transport car 36 and the other end thereof connected with transverse support members 58 or 60. Due to the above construction, the actuation of the shifting cylinders 66 and 68 shifts the transport car 36 in a transverse direction relative to the transport supporting members 58 and 60.

Referring to other parts shown in the drawings, numeral 70 indicates a heat protection plate mounted on the front end of the operation floor 72 for protecting operators 74 and the lining apparatus from the radiation heat of the tap hole 6.

The construction of the injection pipe 2 is shown in detail in FIG. 4 to FIG. 10.

The refractory material injection pipe 2 has a duplicate concentric pipe construction which consists of an outer pipe 2*a* and an inner pipe 2*b* forming an annular cooling water jacket 80 therebetween. The cooling water which is used in this invention can be replaced by another cooling medium such as cooling air, or cooling gas. As shown in FIG. 6 to FIG. 10, the cooling water jacket 80 is separated into a desired number of elongated flow passages (preferably such number should be an even number), wherein half of the flow passages define the cooling water supply passages 80*a* while the remaining half of the flow passages define cooling water return passages 80*b*.

The refractory material injection pipe 2 is provided with a block 82 at the distal end thereof to seal such end. A cutter 84 which has a plurality of cutting blades 84*a* secured to the periphery thereof can be, if desired, attached to the block 84 for a purpose described later. In the proximal end of the block 84, a cooling water reverse passage 88 is formed. The cooling water supplied into the cooling water supply passages 80*a* flows into the cooling water return passages 80*b* through the cooling water reverse passage 88. Furthermore, adjacent to the block 82, the injection opening 10 which injects the refractory material from the injection pipe 2 to the inner surface of the tap hole 6 opens to the wall of the injection pipe 2 substantially perpendicular to the axis of the refractory material injection pipe 2.

Figure 4:
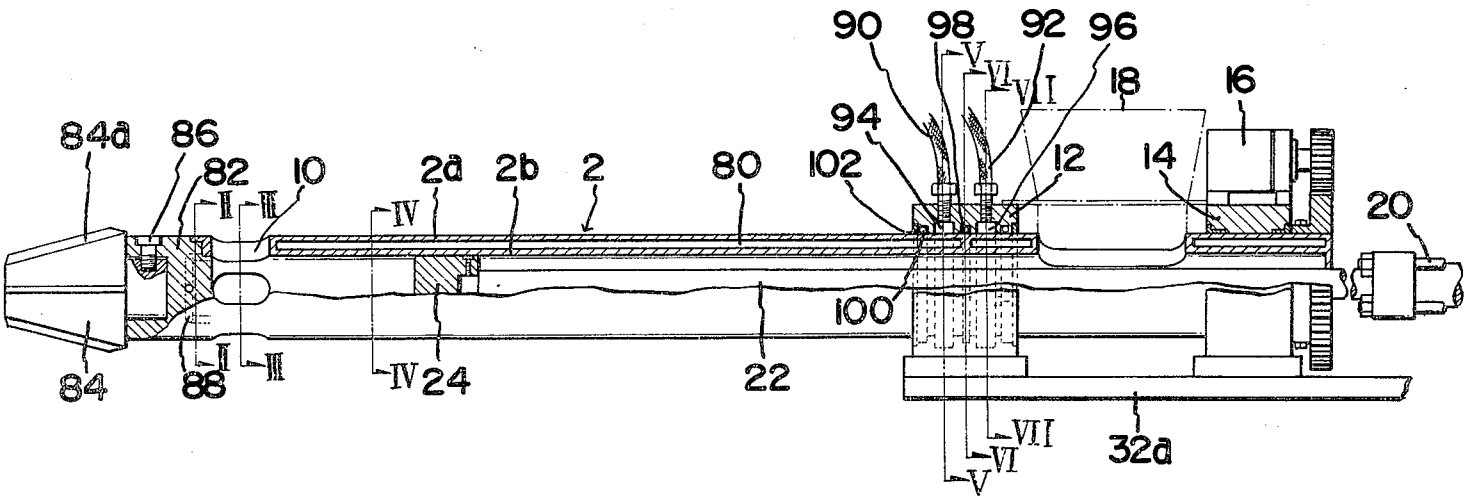
FIG. 4 is an enlarged partial side view with a part broken away of the injection pipe.
Figure 5:
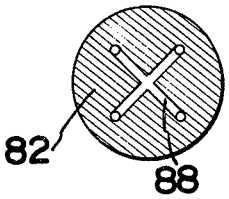
FIG. 5 is a cross-sectional view of the injection pipe taken aong line II—II of FIG. 4.
Figure 6:
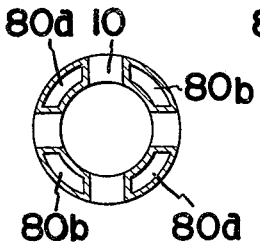
FIG. 6 is a cross-sectional view of the injection pipe taken along line III—III of FIG. 4.
Figure 7:
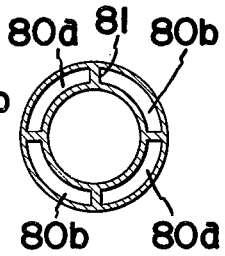
FIG. 7 is a cross-sectional view of the injection pipe taken along line IV—IV of FIG. 4.
Figure 8:
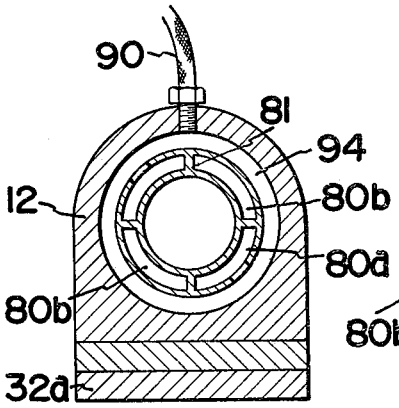
FIG. 8 is a cross-sectional view of the injection pipe taken along line V—V of FIG. 4.
Figure 9:
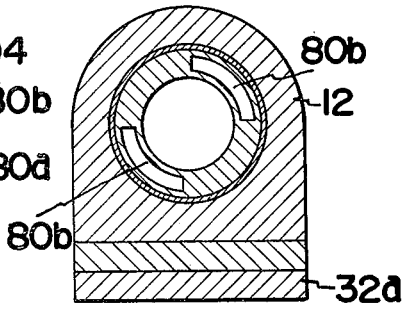
FIG. 9 is a cross-sectional view of the injection pipe taken along line VI—VI of FIG. 4.
Figure 10:
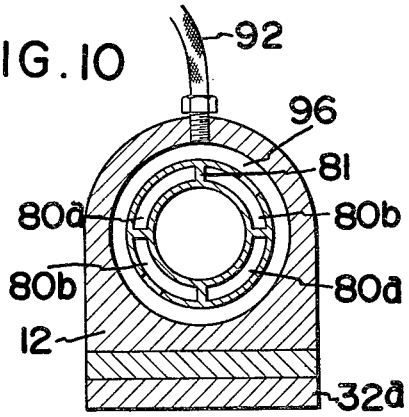
FIG. 10 is a cross-sectional view of the injection pipe taken along line VII—VII of FIG. 4.

As described previously, the refractory material injection pipe 2 is rotatably supported by the first bearing 12 and the second bearing 14. The first bearing 12 is also provided with a water communicating mechanism which can respectively communicate a cooling water supply tube 90 and a cooling water discharge tube 91 with the cooling water supply passage 80*a* and the cooling water return passage 80*b*. Namely, as shown in FIG. 4, the first bearing 12 is provided with an annular water-supply groove 94 and an annular water-discharge groove 96 which are in a parallely spaced-apart relationship.

The cooling water in the supply tube 90 flows into the cooling water supply passages 80*a* by way of the annular water-supply groove 94 while the cooling water in the cooling water return passages 80*b* is discharged into the cooling water discharge tube 92 by way of the annular water return groove 96.

Since the annular water-supply groove 94 and the annular water-return groove 96 are insulated from each other by means of an O-ring 98 while the annular grooves 94 and 96 are respectively insulated from the outside by means of O-rings 100 and bush metal bearings 102, the cooling water is circulated through the entire length of the injection pipe 2 without incurring the leakage of water even when the injection pipe 2 is rotated by the motor 16. Thereby, the refractory material within the injection pipe 2 is efficiently cooled.

The manner in which the method of this invention is conducted along with the above-mentioned apparatus is hereinafter explained.

The transport car 36 is moved to a location adjacent to the tap opening 6 of the converter 4. The elevatable riggers 54, 56 are actuated so as to firmly mount the transport car 36 on the operation floor 72. Shifting cylinders 66, 68 and the front and rear upright cylinders 42, 44 are actuated such that the refractory material injection pipe 2 comes axially into alignment with the axis of the tap hole 6. A carrier extending cylinder 34 is actuated so as to telescopically extend the carrier frame 32. Along with the extension of the carrier frame 32, the injection pipe 2 which is equipped with the perforated mold sleeve 26 and is cooled by the cooling mechanism is inserted into the tap hole 6.

When the injection opening 10 of the injection pipe 2 comes to a position where the opening 10 faces the eroded portion of the interior of the tap hole 6, the actuation of the carrier extending cylinder 34 is stopped.

If desired, prior to the above inserting operation, the cutter 84 can be attached to the front extremity of the refractory material injection pipe 2. Such injection pipe 2 may be inserted into the tap hole 6 and is simultaneously rotated so that the cutter blades 84*a* of the cutter 84 can remove the solidified splashed slag or steel adhered onto the interior of the tap hole 6 as well as the deformed portion of the interior of the tap hole 6. Such operation is generally called "smoothing" and facilitates the insertion of the perforated mold sleeve 26 into the tap hole 6.

Subsequent to the insertion of the injection pipe 2 into the tap hole 6, two mold-sleeve contacting cylinders 28 are actuated such that the annular compacting pad 30 urges the flange portion 26*a* of the perforated mold sleeve 26 onto the outer end opening 6*a* of the tap hole 6 and holds the mold sleeve 26 in place. The refractory material charging device 18 is actuated so as to fill a desired amount of refractory material (the amount necessary for repairing operation) into the injection pipe 2. The refractory material extruding cylinder 20 is actuated so as to discharge the refractory material through the injection opening 10 and the apertures of the perforated mold sleeve 26 and to adhere the refractory material onto the inner surface of the tap hole 6. Along with the above-mentioned extruding operation, the power-operated motor 16 is driven to rotate the refractory material injection pipe 2 and the carrier extending cylinder 34 is actuated so that the refractory material injection pipe 2 moves toward the outer end opening 6*a* of the tap hole 6 and rotates on the axis thereof while applying the refractory material onto the inner surface of the tap hole 6. (It is needless to say that the above refractory material injecting operation can be conducted in a reverse direction, namely from the outer end opening 6*a* toward the innermost end opening of the tap hole 6.)

Due to the above injecting operation, a desired amount of the refractory material is uniformly applied onto the entire length and entire surface of the tap hole 6.

Since the perforated mold sleeve 26 merely loosely encases the refractory material injection pipe 2, the perforated mold sleeve 26 remains within the tap hole 6 even when the injection pipe 2 is withdrawn from the tap hole 6. Along with the withdrawal of the injection pipe, the refractory material is discharged from the injection opening 10 and fills in the space between the inner surface of the tap hole 6 and the mold sleeve 26 and such discharged material firmly binds the perforated mold sleeve 26 to the inner surface of the tap hole while defining the innermost surface of the repaired tap hole 6.

Figure 11:
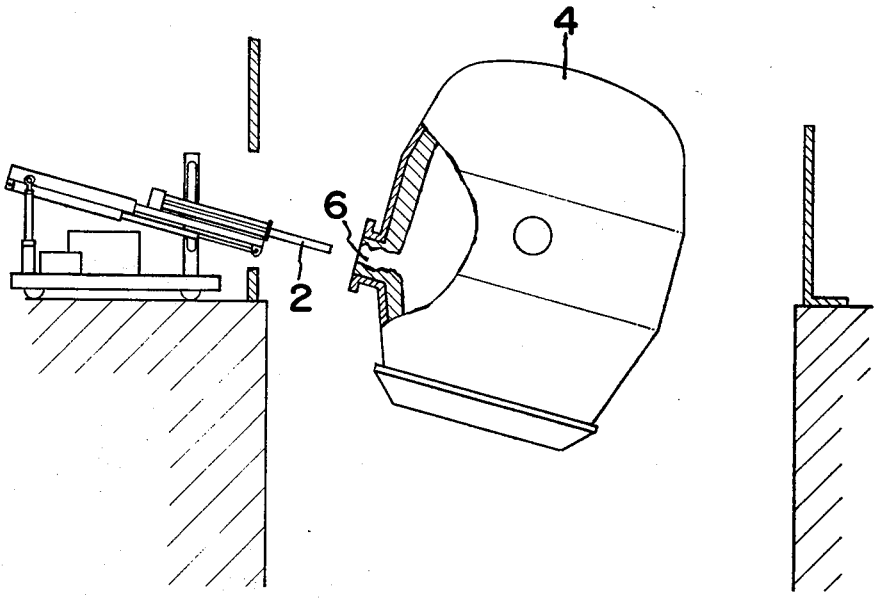
FIG. 11 and FIG. 12 are explanatory views showing the above apparatus in the repairing operation.
Figure 12:
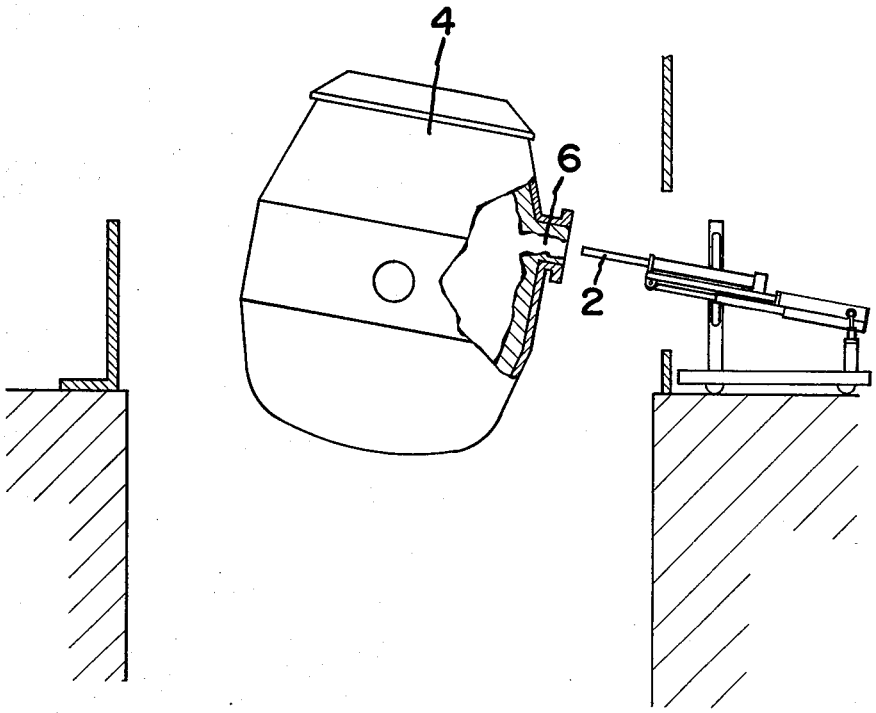

The apparatus of this embodiment repairs the tap hole 6 in a manner as shown in FIG. 11 or FIG. 12. In FIG. 11, the apparatus is positioned on a front working floor.

FIG. 12 shows a repairing operation on a rear working floor.

SECOND EMBODIMENT

Figure 13:
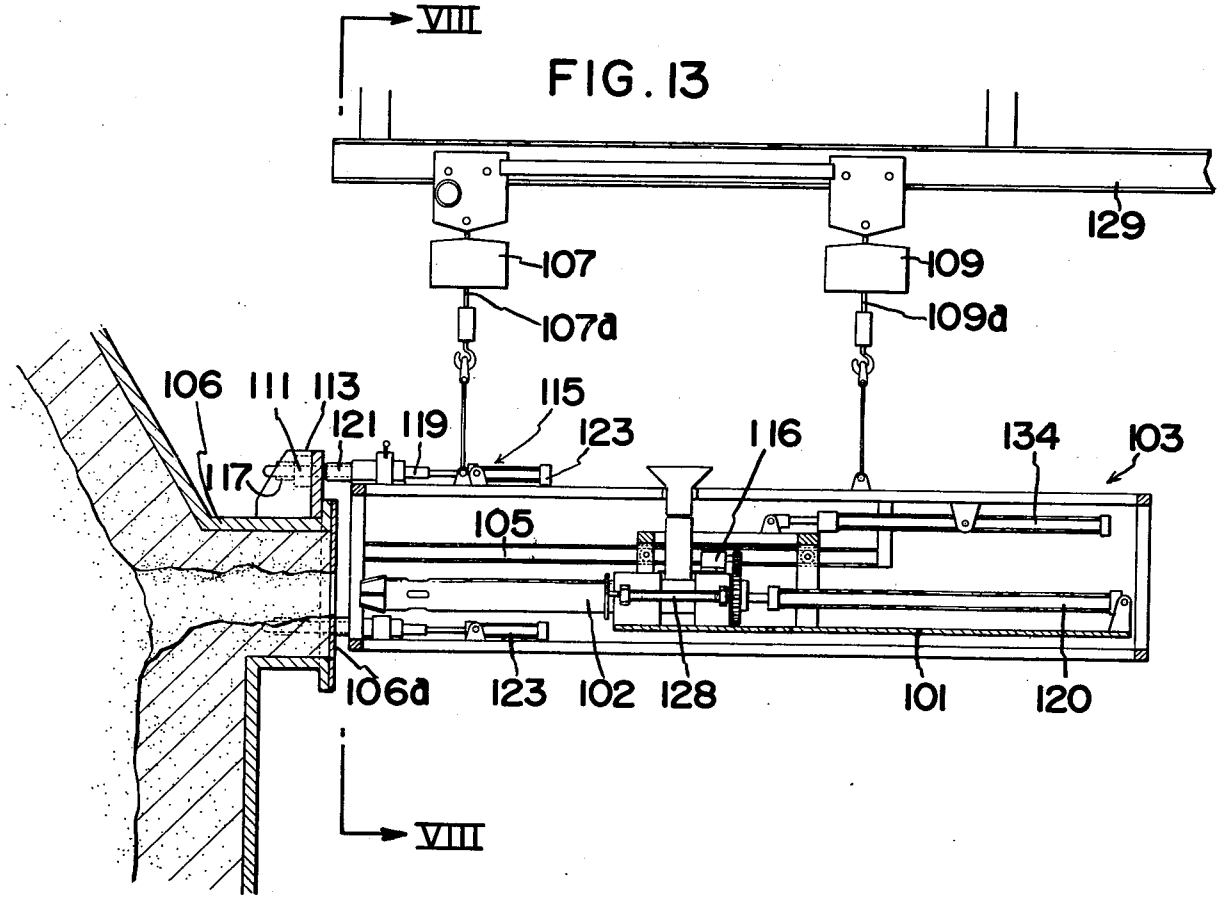
FIG. 13 is a front view of the apparatus of the second embodiment of the present invention.
Figure 14:
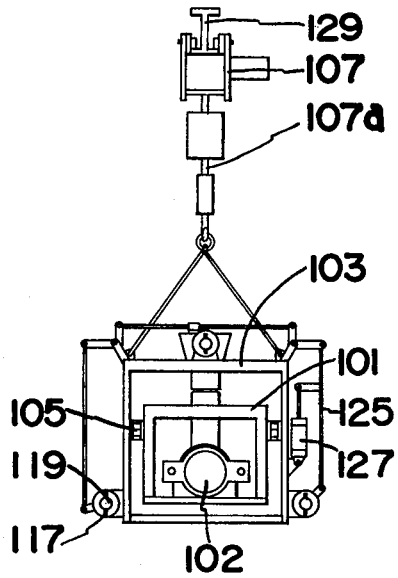
FIG. 14 is a cross-sectional side view of the above apparatus taken along line VIII—VIII of FIG. 13.
Figure 15:
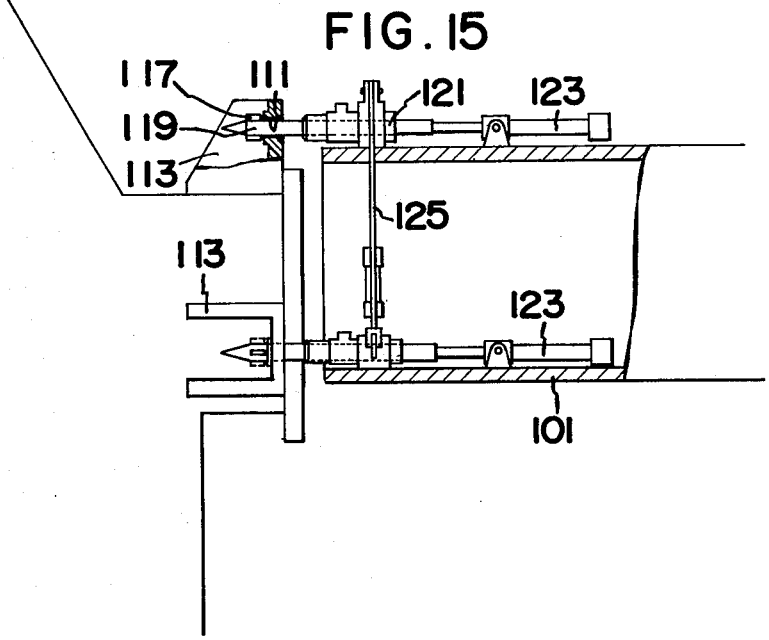
FIG. 15 is an explanatory view showing the rotation-transmitting lever mechanism.

The lining apparatus of this embodiment is shown in FIG. 13 to FIG. 15. In this embodiment, the parts or elements of the apparatus which correspond to those of the first embodiment are indicated by the same numerals, but 100 has been added to each.

In the drawings, numeral 101 is a slide frame which integrally mounts a refractory material injection pipe 102, a refractory material extruding cylinder 120 and a power-operated motor 116 thereon. The slide frame 101 is slidably mounted on a main frame structure 103 such that the slide frame 101 slides along guide rails 105 toward or away from the tap hole 106 of the converter furnace 104. The main frame structure 103 is movably suspended by travelling hoists 107, 109 which, in turn, are movably supported by travelling rails 129 which are fixedly secured to the ceiling of the converter furnace plant.

The lining apparatus of this embodiment is further provided with a clamping device which firmly clamps the main frame structure 103 to the outer end opening 106*a* of the tap hole 106. The clamping device substantially comprises a plurality of clamping brackets 113 secured to the outer periphery of the tap hole 106 and a clamping-shaft actuating mechanism which engages the clamping shafts 119 to the elongated holes 111 formed on the brackets 113.

The clamping-shaft actuating mechanism consists of the above-mentioned clamping shafts 119 which are provided with protrusions 117 on the front extremity thereof, slide guides 121 which guide the slide movement of the clamping shafts 119, reciprocating cylinders 123 which move the clamping shafts 119 toward or away from the elongated holes 111 of the clamping brackets 113, a plurality of rotation-transmitting levers 125 which integrally connects the slide guides 121 and a lever-actuating cylinder 127 which rotates the slide guides 121 and the clamping shafts 119 by way of rotation-transmitting levers 125. Due to the above construction, when the clamping shafts 119 are inserted into the elongated holes 111 and the lever-actuating cylinders 129 are actuated so as to rotate the clamping shafts 119 after the above insertion of the shafts 119 are completed, the protrusions 117 formed on the front extremities of the clamping shafts 119 also rotate. Such rotation provides a firm engagement of the clamping shafts 119 with the clamping brackets 113, whereby the main frame structure 103 is rigidly secured to the tap hole 106.

The manner in which the lining apparatus of this embodiment is operated is hereinafter disclosed.

The travelling hoists 107, 109 are moved along the travelling rails 129 toward the tap hole 106 and the chains 107*a*, 109*a* of the hoists 107, 109 are manipulated such that the refractory material injection pipe 102 comes axially into alignment with the tap hole 106. Although the axis of the tap hole 106 is horizontal in FIG. 13, such axis may take an inclined position. In such a case, the chains 107*a*, 109*a* of the travelling hoists 107, 109 may be wound differently in numbers so as to impart an inclined position to the main frame structure 103.

After the axial aligning of the injection pipe 102 with the tap hole 106, the clamp actuating mechanism 115 is engaged with the clamping brackets 113 to firmly secure the main frame structure 103 to the tap hole 106.

Subsequently, the slide frame 101 on which the refractory material extruding cylinders 120 and the power-operated motor 116 are mounted is moved along the guide rails 105 toward the tap hole 106 and simultaneously the refractory material injection pipe 102 is inserted into the tap hole 106. After being injected in the tap hole 106, the injection pipe 102 repairs the inner surface of the tap hole 106 in the same manner as that of the first embodiment.

Figure 16:
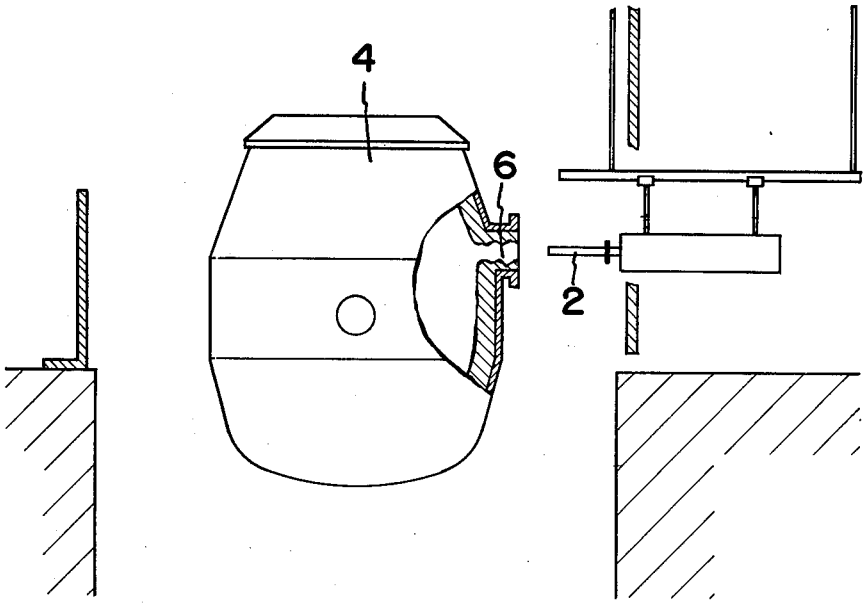
FIG. 16 is an explanatory view showing the above apparatus in the repairing operation.

FIG. 16 shows the lining apparatus of this embodiment repairing the tap hole of the converter furnace. The apparatus of this embodiment can repair the tap hole even when the converter furnace is under the refining operation.

THIRD EMBODIMENT

Figure 17:
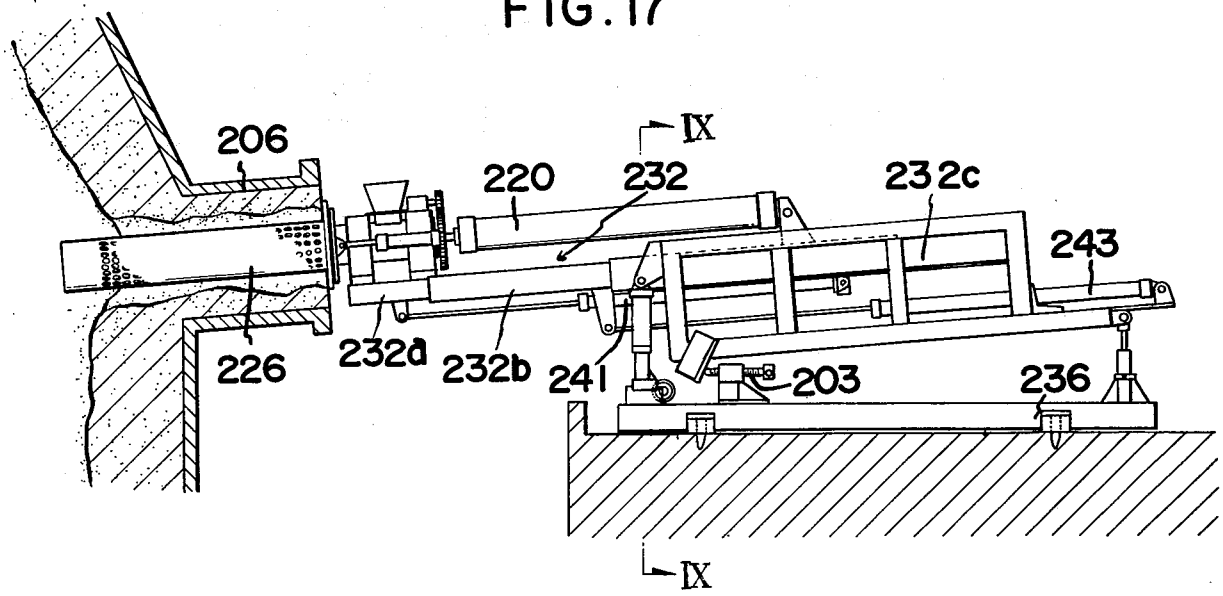
FIG. 17 is a side view of the apparatus of the third embodiment of the present invention.
Figure 18:
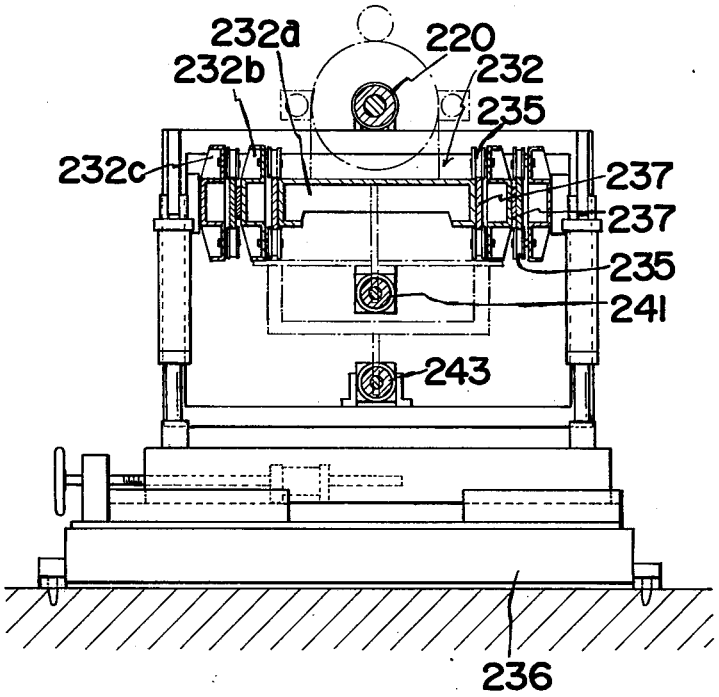
FIG. 18 is a cross-sectional view of the above apparatus taken along line IX—IX of FIG. 17.

The apparatus of this embodiment is shown in FIG. 17 and FIG. 18.

The apparatus of this embodiment substantially has a construction similar to that of the first embodiment provided that a fixed platform 236 is provided in lieu of the transport car 36 and that the slide movement of the carrier frame 232 is effected by a combination of travelling plates 237 and guide rollers 235 and that the first extending portion 232*a* and the second extending portion 232*b* are respectively provided with independent reciprocating cylinders 241 and 243.

In the drawings, the elements or parts which correspond to those of the apparatus of the first embodiment are indicated by the same numerals but 200 has been added to each.

The manner in which the lining apparatus of this embodiment repairs the tap hole of the converter furnace is almost the same as that of the apparatus of the first embodiment. They differ merely in that the reaction force exerted by the actuation of the cylinders such as refractory material extruding cylinders 220 is absorbed by a stopper 203 secured to the fixed platform 236.

As has been described heretofore (first embodiment through third embodiment), the method and apparatus of this invention has the following advantages.

1. Since the refractory material injection pipe is cooled throughout the repairing operation, the refractory material which contains thermosetting binders is restricted from hardening until the material is applied onto the inner surface of the tap hole, whereby the injection operation is smoothly conducted.

2. The injection pipe is provided with the injection opening which opens perpendicular to the axis of the pipe at the front portion thereof while having the refractory material charging inlet at the rear portion thereof. Behind the rear extremity of the injection pipe, the refractory material extruding device (the extruding cylinder) is coaxially disposed. In the repairing operation, a desired amount of refractory material (necessary for repairing the eroded portion of the tap hole) is charged into the injection pipe through the refractory material charging inlet, subsequently the refractory material extruding cylinder is actuated so as to extrude all the refractory material through the injection opening and apertures of the perforated mold sleeve into the space between the interior of the tap hole and the perforated mold sleeve and thus extruded refractory material is uniformly applied onto the inner surface of the tap hole.

In the above repairing operation, since all the refractory material in the injection pipe can be extruded, the occurrence of the waste of the refractory material can be prevented. Furthermore, since no refractory material remains within the injection pipe after the repairing operation, the maintenance of the injection pipe is facilitated.

3. Since the water communicating mechanism provided in the injection-pipe-supporting bearing can assure the completely sealed circulation of the cooling water within the cooling water jacket even when the injection pipe is being rotated, the injection pipe is efficiently cooled.

4. The above-mentioned cooling mechanism can prevent the refractory material injection pipe from warping under a high temperature repairing condition.

5. The refractory material injection pipe is of a circular sleeve construction, the outer diameter of which is smaller than the ideal inner diameter of the tap hole. Such ideal diameter is determined such that the injection pipe can be smoothly withdrawn from the perforated mold sleeve. Furthermore, due to such determination of the diameter, regardless of using either the refractory material of high viscosity or the refractory material of high fluidity, the watercooled injection pipe can efficiently prevent the seizure of the refractory material within the injection pipe. After extruding the refractory material from the injection opening of the injection pipe, the injection pipe is held in place for a predetermined time during which the applied material is hardened and thereby preventing the reflux of the applied material. Still furthermore, the water-cooled injection pipe can restrict the thermal expansion of the refractory material applied onto the interior of the tap hole which is caused by the evaporation of the binders or water during the sintering of the applied refractory material whereby preventing the increase of the porosity of the applied refractory material.

6. The provision of the perforated mold sleeve provides an accurate and ideal inner diameter to the tap hole of the converter furnace after repairing operation. Furthermore, the perforated mold sleeve works so as to compress the refractory material extruded into the space formed between the mold sleeve and the eroded inner surface of the tap hole so that the applied refractory material can show low porosity and high wear resistance.

7. Prior to the inserting of the injection pipe into the tap hole of the converter furnace, the perforated mold sleeve is mounted on the injection pipe. Subsequently, the injection pipe is inserted into the tap hole. Therefore, the injection pipe can readily obtain the axial alignment with the axis of the tap hole to be repaired.

8. While extruding the refractory material from the injection pipe to the interior of the tap hole, the injection pipe can move axially within the tap hole, the amount of the refractory material to be applied is adjusted corresponding to the eroded conditions of the respective portions of the interior of the tap hole.

9. Since the injection pipe can be rotated by the rotating mechanism in the repairing operation, the refractory material is uniformly extruded through apertures of the perforated mold sleeve, thereby the thus extruded refractory material can firmly adhere to the interior of the furnace.

10. The injection pipe is withdrawn from the tap hole along with the rotation thereof so that the interior of the tap hole after the repairing operation provides a smooth surface as well as uniform diameter throughout the entire length of the tap hole.

11. The perforated mold sleeve has the inner diameter which corresponds to the ideal inner diameter of the tap hole obtained through the repairing operation. Such perforated mold sleeve can have apertures either on the entire surface or the partial surface thereof.

12. When the interior of the tap hole is heavily eroded and exposes an extremely deformed contour, the above-mentioned usual repairing operation which is conducted after each tapping operation may be impossible. In such a case, prior to the injection operation, a cutter is secured to the front extremity of the refractory material injection pipe and such injection pipe is inserted into the tap hole so as to remove the solidified slag or steel on the interior of the tap hole as well as extremely deformed portions of the interior of the tap hole. Such removal operation facilitates the insertion of the perforated mold sleeve.

What we claim is:

1. In an apparatus for repairing a tap hole of a converter comprising (i) a refractory material injection pipe which is provided with a refractory material charging inlet at a proximal portion thereof and at least one refractory material injection opening at a distal portion thereof, (ii) the distal portion of said injection pipe being of a construction which allows the replaceable attachment of a hole-refining cutter thereto, (iii) means for charging refractory material into said injection pipe, (iv) means for extruding refractory material from said injection pipe to the inner wall of said tap hole, (v) means for supporting said injection pipe, said charging means and said extruding means, and (vi) cooling means provided with said refractory material injection pipe which cools said injection pipe substantially through the entire length thereof.

2. In an apparatus for repairing a tap hole of a converter comprising (i) a refractory material injection pipe which is provided with a refractory material charging inlet at a proximal portion thereof and at least one refractory material injection opening at a distal portion thereof, (ii) means for charging refractory material into said injection pipe, (iii) means for extruding refractory material from said injection pipe to the inner wall of said tap hole, (iv) means for supporting said injection pipe, said charging means and said extruding means, and (v) cooling means provided substantially along the length of said injection pipe for cooling the entire length of said injection pipe.

3. Apparatus for repairing a tap hole of a converter according to claim 2, wherein said cooling means is a cooling medium jacket which is formed between concentric outer and inner walls of said injection pipe of a duplicate pipe construction.

4. Apparatus for repairing a tap hole of a converter according to claim 3, wherein said cooling medium jacket is separated into a desired number of flow passages by a corresponding number of longitudinal partition plates, said flow passages consisting of cooling medium supply passages and cooling medium return passages.

5. In an apparatus for repairing a tap hole of a converter comprising (i) a refractory material injection pipe which is provided with a refractory material charging inlet at a proximal portion thereof and at least one refractory material injection opening at a distal portion thereof, (ii) a pipe rotating mechanism disposed adjacent to said proximal portion of said injection pipe for rotating said injection pipe on the axis thereof, (iii) means for charging refractory material into said injection pipe, (iv) means for extruding refractory material from said injection pipe to the inner wall of said tap hole, (v) means for supporting said injection pipe, said charging means and said extruding means, and (vi) cooling means provided with said refractory material injection pipe which cools said injection pipe substantially through the entire length thereof, said cooling means being a cooling medium jacket which is formed between concentric outer and inner walls of said injection pipe of a duplicate pipe construction, said cooling medium jacket being separated into a desired number of flow passages by a corresponding number of longitudinal partition plates, said flow passages consisting of cooling medium supply passages and cooling medium return passages.

6. Apparatus for repairing a tap hole of a converter according to claim 5, wherein said pipe rotating mechanism consists of a power-operated motor which has an output shaft thereof connected with said proximal portion of said injection pipe and bearing means which rotatably support a proximal portion of said injection pipe.

7. Apparatus for repairing a tap hole of a converter according to claim 6, wherein said bearing means is provided with a cooling-medium communicating mechanism which communicates an outside cooling medium supply line and an outside cooling medium return line with said cooling medium jacket which is rotatable along with the rotation of said injection pipe.

8. Apparatus for repairing a tap hole of a converter according to claim 7, wherein said cooling-medium communicating mechanism consists of an annular supply groove and an annular return groove formed on the inner surface of said bearing means in a parallely spaced-apart relationship, said annular supply groove communicating said cooling medium supply line with said cooling medium supply passages, said annular return groove communicating said cooling medium return line with said cooling medium return passages.

9. In an apparatus for repairing a tap hole of a converter comprising (i) a refractory material injection pipe which is provided with a refractory material charging inlet at a proximal portion thereof and at least one refractory material injection opening at a distal portion thereof, (ii) a pipe rotating mechanism which is disposed adjacent to said proximal portion of said injection pipe for rotating said injection pipe on the axis thereof, (iii) means for charging refractory material into said injection pipe, (iv) means for extruding refractory material from said injection pipe to the inner wall of said tap hole, (v) means for supporting said injection pipe, said charging means and said extruding means, and (vi) cooling means provided with said refractory material injection pipe which cools said injection pipe substantially through the entire length thereof.

10. In an apparatus for repairing a tap hole of a converter comprising (i) a refractory material injection pipe which is provided with a refractory material charging inlet at a proximal portion thereof and at least one refractory material injection opening at a distal portion thereof, (ii) means for charging refractory material into said injection pipe, (iii) means for extruding refractory material from said injection pipe to the inner wall of said tap hole, (iv) a perforated mold sleeve which encases said injection pipe substantially through the entire length thereof, said perforated mold sleeve having a diameter which corresponds to a diameter of a repaired tap hole thus forming a refractory material extruding space between said mold sleeve and said inner surface of said tap hole, (v) means for supporting said injection pipe, said charging means and said extruding means, and (vi) cooling means provided with said refractory material injection pipe which cools said injection pipe substantially through the entire length thereof.

11. Apparatus for repairing a tap hole of a converter according to claim 10, wherein said perforated sleeve has a multiplicity of apertures formed on the entire length thereof.

12. Apparatus for repairing a tap hole of a converter according to claim 10, wherein said perforated mold sleeve has a multiplicity of apertures formed on a partial portion thereof.

13. Apparatus for repairing a tap hole of a converter according to claim 10, wherein said perforated mold sleeve has one end provided with an annular flange portion which has a diameter larger than that of an outlet opening of said tap hole.

14. Apparatus for repairing a tap hole of a converter according to claim 13, wherein an annular compacting pad which has substantially the same shape as that of said annular flange portion is slidably mounted on the outer peripheral surface of the proximal portion of said injection pipe and said compacting pad is connected with actuating rods of mold-sleeve urging cylinders disposed adjacent to said proximal portion of said injection pipe, whereby the actuation of said mold-sleeve urging cylinder urges said annular flange portion of said perforated mold sleeve to said outlet opening of said tap hole by way of said compacting pad.

15. In an apparatus for repairing a tap hole of a converter comprising (i) a refractory material injection pipe which is provided with a refractory material charging inlet at a proximal portion thereof and at least one refractory material injection opening at a distal portion thereof, (ii) said refractory material injection opening formed on the wall of said injection pipe being an elongated opening elongated in a direction along and parallel to the axis of said injection pipe, (iii) means for charging refractory material into said injection pipe, (iv) means for extruding refractory material from said injection pipe to the inner wall of said tap hole, (v) means for supporting said injection pipe, said charging means and said extruding means, and (vi) cooling means provided with said refractory material injection pipe which cools said injection pipe substantially through the entire length thereof.

16. In an apparatus for repairing a tap hole of a converter comprising (i) a refractory material injection pipe which is provided with a refractory material charging inlet at a proximal portion thereof and at least one refractory material injection opening at a distal portion thereof, (ii) means for charging refractory material into said injection pipe, (iii) means for extruding refractory material from said injection pipe to the inner wall of said tap hole, said extruding means comprising a refractory material extruding cylinder which is disposed coaxially on the rear extension of the axis of the injection pipe, said extruding cylinder having an actuating rod thereof reciprocated within and along said injection pipe, (iv) means for supporting said injection pipe, said charging means and said extruding means, and (v) cooling means provided with said refractory material injection pipe which cools said injection pipe substantially through the entire length thereof.

17. In an apparatus for repairing a tap hole of a converter comprising (i) a refractory material injection pipe which is provided with a refractory material charging inlet at a proximal portion thereof and at least one refractory material injection opening at a distal portion thereof, (ii) means for charging refractory material into said injection pipe, (iii) means for extruding refractory material from said injection pipe to the inner wall of said tap hole, (iv) means for supporting said injection pipe, said charging means and said extruding means, (v) said supporting means comprises a telescopically extendable frame structure and a platform which support said frame structure, said frame structure carrying said injection pipe, charging means, and said extruding means, and (vi) cooling means provided with said refractory material injection pipe which cools said injection pipe substantially through the entire length thereof.

18. Apparatus for repairing a tap hole of a converter according to claim 17, wherein said extendable frame structure is tiltable in a longitudinal direction on said platform by a tilting mechanism mounted on said platform.

19. Apparatus for repairing a tap hole of a converter according to claim 18, wherein said tilting mechanism comprises a front upright cylinder and a rear upright cylinder mounted on the front and rear portion of said platform respectively, said front and rear cylinders having their actuating rods pivotally connected with the corresponding portions of said extendable frame structure.

20. Apparatus for repairing a tap hole of a converter according to claim 17, wherein said platform is a movable transport car movable on a working floor.

21. Apparatus for repairing a tap hole of a converter according to claim 20, wherein said transport car is provided with front and rear transverse grooves formed on the front and rear portion thereof, said front and rear transverse grooves slidably accommodates front and rear transverse support members, said each transverse support member has elevatable riggers at both ends thereof, said elevatable rigger floats said transport car by way of said transverse support members, and front and rear shifting cylinders are disposed parallel to said front and rear transverse support members for imparting a transverse shifting of said transport car relative to said transverse support members.

22. In an apparatus for repairing a tap hole of a converter comprising (i) a refractory material injection pipe which is provided with a refractory material charging inlet at a proximal portion thereof and at least one refractory material injection opening at a distal portion thereof, (ii) means for charging refractory material into said injection pipe, (iii) means for extruding refractory material from said injection pipe to the inner wall of said tap hole, (iv) means for supporting said injection pipe, said charging means and said extruding means, (v) said supporting means comprises a slide frame which mounts said injection pipe, said charging means and said extruding means integrally, a main frame which slidably carries said slide frame, and crane means which movably suspends said main frame from a ceiling of a converter furnace plant, and (vi) cooling means provided with said refractory material injection pipe which cools said injection pipe substantially through the entire length thereof.

23. Apparatus for repairing a tap hole of a converter according to claim 22, wherein said main frame is further provided with a connecting means which firmly connects said main frame to said outlet opening of said tap hole.

24. Apparatus for repairing a tap hole of a converter according to claim 23, wherein said connecting means comprises a plurality of brackets secured to the periphery of the front portion of said tap hole, said each bracket provided with a connecting-pin-insert hole, connecting pins mounted on the tap-hole side of said main frame, said pins provided with latch protrusions on the front extremities thereof, means for reciprocating said connecting pins and rotating means which rotates said pins after said pins are inserted into said insert holes so as to engage said latch protrusions with said brackets.

* * * * *